US008913908B2

(12) United States Patent
Inukai

(10) Patent No.: US 8,913,908 B2
(45) Date of Patent: Dec. 16, 2014

(54) DEVELOPING VOLTAGE CONTROL USING A DEBOOST CIRCUIT IN AN IMAGE FORMING APPARATUS

(75) Inventor: Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 321 days.

(21) Appl. No.: 13/224,732

(22) Filed: Sep. 2, 2011

(65) Prior Publication Data

US 2012/0057888 A1 Mar. 8, 2012

(30) Foreign Application Priority Data

Sep. 6, 2010 (JP) ..... 2010-199137

(51) Int. Cl.
*G03G 15/02* (2006.01)

(52) U.S. Cl.
CPC ..... *G03G 15/0266* (2013.01); *G03G 15/0291* (2013.01); *G03G 2215/0141* (2013.01)
USPC ..... 399/50

(58) Field of Classification Search
USPC ..... 399/50, 53, 55, 170, 171
See application file for complete search history.

(56) References Cited

U.S. PATENT DOCUMENTS

| | | | | |
|---|---|---|---|---|
| 4,922,293 | A * | 5/1990 | Bando | 399/38 |
| 5,309,207 | A * | 5/1994 | Omori | 399/55 |
| 5,572,295 | A | 11/1996 | Sakagami et al. | |

FOREIGN PATENT DOCUMENTS

| | | |
|---|---|---|
| JP | 03-142483 | 6/1991 |
| JP | 05-323773 | 12/1993 |
| JP | 07-244420 | 9/1995 |
| JP | 08-054768 | 2/1996 |
| JP | H09-230675 A | 9/1997 |
| JP | 11-133765 | 5/1999 |
| JP | 2006-003815 A | 1/2006 |
| JP | 2007-086229 | 4/2007 |

OTHER PUBLICATIONS

Office Action received in corresponding Japanese Application No. 2010-199137 issued Dec. 16, 2013.

* cited by examiner

*Primary Examiner* — Quana M Grainger
(74) *Attorney, Agent, or Firm* — Banner & Witcoff, Ltd.

(57) ABSTRACT

An image forming apparatus includes: a photosensitive member; a scorotron charger; a developing device; a voltage application circuit; a constant-voltage circuit; a first control device; a deboost circuit; and a second control device, wherein the deboost circuit has a circuit configuration in which a resistor and a control transistor are connected in series with each other, and deboosts the grid voltage by a voltage drop of the resistor to generate the developing voltage, and the second control device provides a control signal to the control transistor to control a current flowing in the resistor, thereby controlling the level of the developing voltage.

5 Claims, 11 Drawing Sheets

DEVELOPING VOLTAGE CONTROL USING A DEBOOST CIRCUIT IN AN IMAGE FORMING APPARATUS

CROSS REFERENCE TO RELATED APPLICATION

The present application claims priority from Japanese Patent Application No. 2010-199137, which was filed on Sep. 6, 2010, the disclosure of which is herein incorporated by reference in its entirety.

TECHNICAL FIELD

The present invention relates to an image forming apparatus.

BACKGROUND

A laser printer (image forming apparatus) has a photosensitive member, a charger, and a developing device, and is configured such that a high voltage is applied to the charger and the developing device so as to perform a charging process and a developing process. In this type of image forming apparatus, reduction in the number of parts and reduction in the size of the apparatus are demanded, and various proposals are made heretofore. For example, Patent Document 1 describes a technique in which a developing voltage which is applied to a developing device is produced from a grid voltage which is applied to the grid of the charger, and a power supply for generating a developing voltage is removed.

[Patent Document 1] JP-A-H08-054768

SUMMARY

In order to increase image quality, a configuration is preferably made such that a developing voltage which is applied to each developing device can be minutely adjusted. This is because, if toner deterioration progresses, to the same extent it becomes difficult to charge toner, thus it is necessary to set a developing voltage in accordance with the degree of deterioration. In the technique of Patent Document 1, the grid voltage is divided by a resistor to produce the developing voltage. For this reason, it is difficult to minutely adjust each developing voltage.

The invention has been finalized on the basis of the above-described situation, and an object of the invention is to achieve both reduction in the size of a high-voltage power supply device constituting an image forming apparatus and high image quality.

According to a first aspect of the invention, an image forming apparatus includes a photosensitive member, a scorotron charger which has a wire and a grid, and charges the photosensitive member, a developing device which supplies a developer to the photosensitive member, a voltage application circuit which applies a voltage to the scorotron charger, a constant-voltage circuit which sets a grid voltage of the grid to a constant voltage between the grid and the ground, a first control device which controls an output voltage of the voltage application circuit, a deboost circuit which deboosts the grid voltage between the grid and the ground to generate a developing voltage being applied to the developing device, and a second control device which controls an output of the deboost circuit. The deboost circuit has a circuit configuration in which a resistor and a control transistor are connected in series with each other, and deboosts the grid voltage by a voltage drop of the resistor to generate the developing voltage. The second control device provides a control signal to the control transistor to control a current flowing in the resistor, thereby controlling the level of the developing voltage.

With this configuration, a configuration is made in which the grid voltage is deboosted to produce the developing voltage. For this reason, it is possible to reduce the size of a high-voltage power supply device which constitutes the image forming apparatus. According to this aspect of the invention, the value of a current flowing in the resistor is adjusted by the control transistor, such that the developing voltage can be continuously controlled in a nonstep manner. Therefore, it becomes possible to minutely control the developing voltage, making it possible to achieve high image quality.

According to a second aspect of the invention, the image forming apparatus according to the first aspect of the invention may further include a grid current calculating section which calculates a grid current flowing in the grid. The first control device may control the output voltage of the voltage application circuit such that the grid current becomes a target value, the deboost circuit may include a developing voltage detection circuit which detects the developing voltage, and the second control device may control the current flowing in the resistor such that a detection value of the developing voltage detection circuit becomes a target value of the developing voltage. With this configuration, the developing voltage is detected and fed back to the second control device, making it possible to accurately control the developing voltage to the target value.

According to a third aspect of the invention, in the image forming apparatus according to the second aspect of the invention, the constant-voltage circuit may be connected to the ground through a current detecting section, the deboost circuit is directly connected to the ground, and the grid current calculating section may calculate a first branch current in the grid current branching into the constant-voltage circuit from a detection value of the current detecting section, may calculate a second branch current in the grid current branching into the deboost circuit from a voltage difference between the grid voltage and the developing voltage and the resistor, and may totalize the calculated first branch current and second branch current to calculate the grid current. With this configuration, a reference potential of the deboost circuit is grounded. For this reason, the reference potential is stabilized, such that the developing voltage is stabilized.

According to a fourth aspect of the invention, in the image forming apparatus according to the second aspect of the invention, the constant-voltage circuit and the deboost circuit may be connected to the ground through a common current detecting section, and the grid current calculating section may calculate the grid current from a detection value of the common current detecting section. With this configuration, it becomes possible to obtain the grid current simply and accurately.

According to a fifth aspect of the invention, in the image forming apparatus according to the second aspect of the invention, the constant-voltage circuit and the control transistor of the deboost circuit may be connected to the ground through a common current detecting section, and the developing voltage detection circuit of the deboost circuit may be connected directly to the ground. The grid current calculating section may calculate a total current of a first branch current in the grid current branching into the constant-voltage circuit and a third branch current branching into the control transistor of the deboost circuit from a detection value of the current detecting section, may calculate a fourth branch current in the grid current branching into the developing voltage detection circuit of the deboost circuit from the detection value of the developing voltage detection circuit and a resistance value of the developing voltage detection circuit, and may totalize the calculated total current and fourth branch current to calculate the grid current. With this configuration, the developing voltage is comparatively stabilized. It also becomes possible to comparatively simply obtain the grid current.

According to a sixth aspect of the invention, in the image forming apparatus according to any one of the second to fifth aspects of the invention, a single or a plurality of photosensitive members may be provided, a plurality of scorotron chargers may be provided for the single photosensitive member or may be respectively provided for the plurality of photosensitive members to charge the single or the plurality of photosensitive members, a plurality of developing devices may be provided for the signal photosensitive member or may be respectively provided for the plurality of photosensitive members to supply developers of respective colors to the single or the plurality of photosensitive members, the scorotron chargers may be connected commonly to the voltage application circuit, the grids of the scorotron chargers may be connected commonly to the constant-voltage circuit, and the grid current calculating section may totalize the grid current flowing in each grid to calculate a total grid current. With this configuration, the voltage application circuit and the constant-voltage circuit are shared by the chargers. Therefore, it becomes possible to reduce the number of circuits compared to a case where these circuits are separately provided for the chargers.

According to a seventh aspect of the invention, in the image forming apparatus according to any one of the second to fifth aspects of the invention, a single or a plurality of photosensitive members may be provided, a plurality of scorotron chargers may be provided for the single photosensitive member or may be respectively provided for the plurality of photosensitive members to charge the single or the plurality of photosensitive members, a plurality of developing devices may be provided for the signal photosensitive member or may be respectively provided for the plurality of photosensitive members to supply developers of respective colors to the single or the plurality of photosensitive members, the scorotron chargers may be connected commonly to the voltage application circuit, the constant-voltage circuit may be individually provided to correspond to each of the grids of the scorotron chargers, the grid current calculating section may calculate the grid current flowing in each of the grids of the scorotron chargers, and the second control device may perform control to decrease a target value of the developing voltage to a developing device corresponding to a scorotron charger, in which the grid current is low, from among the developing devices of the respective colors and to increase a target value of the developing voltage to a developing device corresponding to a scorotron charger, in which the grid current is high, from among the developing devices of the respective colors.

A charging voltage of the photosensitive member tends to be high when the grid current is large and to be low when the grid current is small. According to the seventh aspect of the invention, a target voltage of the developing voltage decreases in a developing device corresponding to a charger in which the grid current is low, and a target voltage of the developing voltage increases in a developing device corresponding to a charger in which the grid current is high. For this reason, it becomes possible to equalize a voltage difference between the charging voltage of the photosensitive member and the developing voltage of the developing device for each color. Therefore, it becomes possible to allow toner of each color to be uniformly adhered to the corresponding photosensitive member, thereby achieving high image quality.

According to the aspects of the invention, it becomes possible to achieve both reduction in the size of a high-voltage power supply device constituting an image forming apparatus and high image quality.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Embodiment 1

Embodiment 1 of the invention will be described with reference to FIGS. 1 to 4.

1. Overall Configuration of Printer

Figure 1:
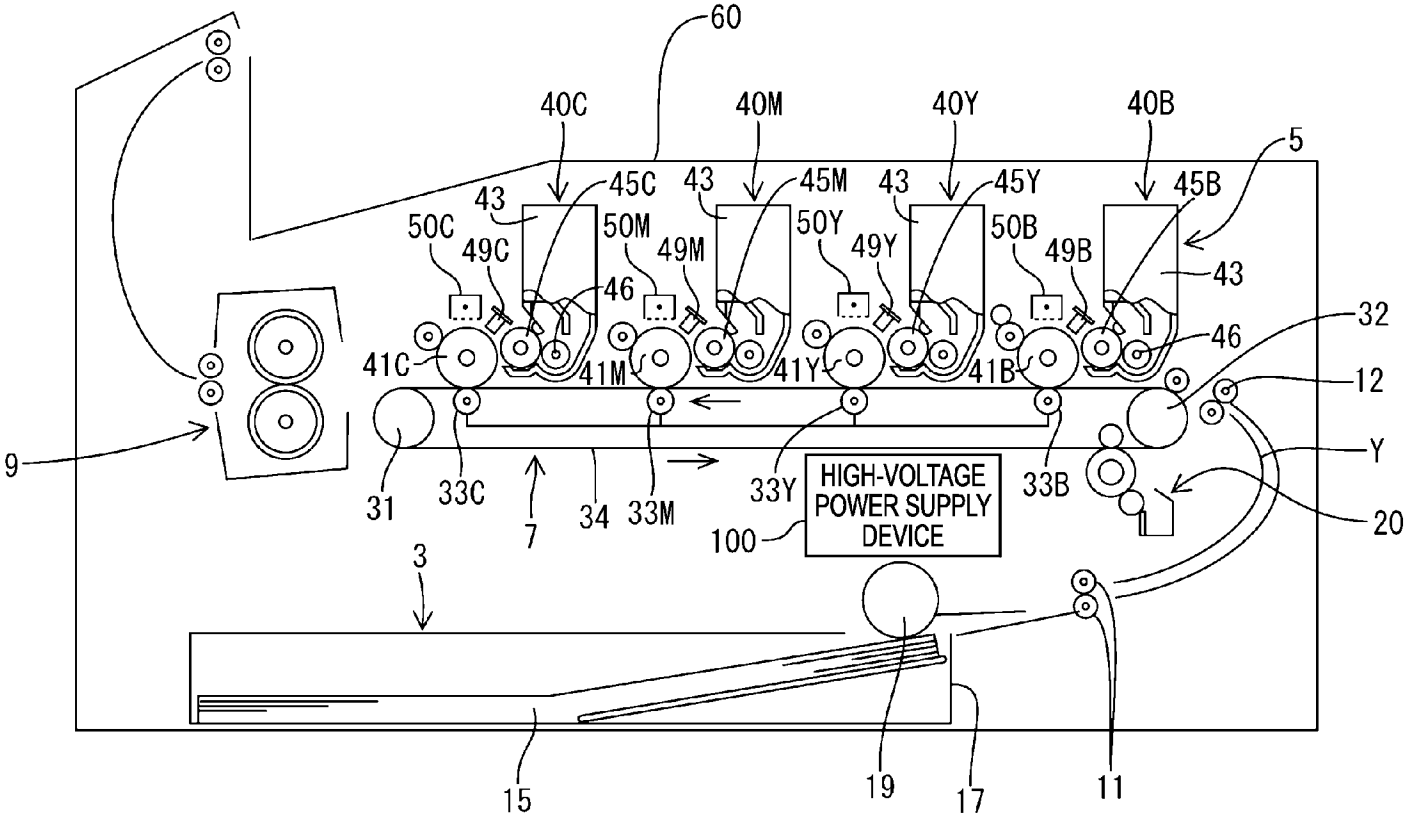
FIG. 1 is a schematic sectional view showing the internal configuration of a printer according to Embodiment 1 of the invention.

FIG. 1 is a schematic sectional view showing the internal configuration of a printer 1 (an example of an "image forming apparatus" of the invention) of this embodiment. In the following description, when the constituent elements are distinguished from each other by colors, the suffixes of B (black), Y (yellow), M (magenta), and C (cyan) are attached to the reference numerals of the respective sections. When the constituent elements are not distinguished from each other, the suffixes are omitted. The constituent elements of each color of B (black), Y (yellow), M (magenta), and C (cyan) are called a channel.

The printer 1 includes a sheet feed section 3, an image forming section 5, a conveying mechanism 7, a fixing section 9, a belt cleaning mechanism 20, and a high-voltage power supply device 100.

The sheet feed section 3 is provided at the lowermost part of the printer 1, and includes a tray 17 which stores sheets (paper, OHP sheets, or the like) 15, and a pickup roller 19. The sheets 15 stored in the tray 17 are picked up by the pickup roller 19 one by one and sent to the conveying mechanism 7 through a conveying roller 11 and a registration roller 12.

The conveying mechanism 7 conveys the sheet 15 and is provided above the sheet feed section 3 inside the printer 1. The conveying mechanism 7 includes a driving roller 31, a driven roller 32, and a belt 34. The belt 34 is stretched between the driving roller 31 and the driven roller 32. If the driving roller 31 rotates, the surface of the belt 34 facing a photosensitive drum 41 moves from the right side of FIG. 1 to the left side. Thus, the sheet 15 sent from the registration roller 12 is conveyed below the image forming section 5.

The belt 34 is provided with four transfer rollers 33B, 33Y, 33M, and 33C corresponding to four photosensitive drums 41B, 41Y, 41M, and 41C. The transfer rollers 33 are provided at the positions facing the photosensitive drums 41B, 41Y, 41M, and 41C with the belt 34 interposed therebetween.

The image forming section 5 includes four process units 40B, 40Y, 40M, and 40C and four exposure devices 49B, 49Y, 49M, and 49C. The process units 40B, 40Y, 40M, and 40C are arranged in a row in the conveying direction (the left-right direction of FIG. 1) of the sheet 15.

The process units 40 have the same structure, and respectively include the photosensitive drums 41B, 41Y, 41M, and 41C (an example of a "photosensitive member" of the invention) of the respective colors, toner cases 43 which accommodate toner (for example, positively chargeable nonmagnetic one component toner) of the respective colors, developing rollers (an example of a "developing device" of the invention) 45B, 45Y, 45M, and 45C (collectively denoted by 45), and chargers 50B, 50Y, 50M, and 50C (collectively denoted by 50). Toner is an example of a "developer" of the invention.

In each of the photosensitive drums 41B, 41Y, 41M, and 41C, for example, a positively chargeable photosensitive layer is formed on a base material made of aluminum, and the base material made of aluminum is connected to the ground of the printer 1.

The developing rollers 45B, 45Y, 45M, and 45C are arranged to face supply rollers 46 at the lower parts of the toner cases 43. Developing voltages Vd1 to Vd4 are respectively applied to the developing rollers 45B, 45Y, 45M, and 45C by deboost circuits 300B, 300Y, 300M, and 300C described below. The developing rollers 45B to 45C have a function of supplying toner supplied through the supply rollers 46 onto the photosensitive drums 41B, 41Y, 41M, and 41C while toner is positively charged by the actions of the developing voltages Vd1 to Vd4.

The charges 50B, 50Y, 50M, and 50C are scorotron chargers, and respectively have a shield case 51, a wire 53, and a metallic grid 55. The shield case 51 is a square tube shape which is long in the rotation shaft direction of the photosensitive drum 41. In the shield case 51, a surface facing the photosensitive drum 41 is opened as a discharge port 52 (see FIG. 3).

The wire 53 is, for example, a tungsten wire. The wire 53 is stretched in the rotation shaft direction inside the shield case 51, and a high voltage is applied to the wire 53 by the voltage application circuit 200 described below. With the application of the high voltage, the wire 53 causes corona discharge inside the shield case 51. Ions generated by corona discharge flow from the discharge port 52 toward the photosensitive drum 41 as a discharge current to uniformly positively charge the surface of the photosensitive drum 41.

A plate-shaped grid 55 having a slit or a trough hole is attached to the discharge port 52 of the shield case 51. A voltage is applied to the grid 55 and the applied voltage is controlled, making it possible to control a charging voltage of the photosensitive drum 41.

The exposure devices 49B, 49Y, 49M, and 49C respectively have, for example, a plurality of light-emitting elements (for example, LEDs or laser light sources) arranged in a row in the rotation shaft direction of the photosensitive drums 41B, 41Y, 41M, and 41C. The exposure devices 49B, 49Y, 49M, and 49C have a function of emitting light in accordance with image data input from the outside to form electrostatic latent images on the surfaces of the photosensitive drums 41B, 41Y, 41M, and 41C.

Simple description will be provided as to a sequence of image formation processing by the laser printer 1 configured as above. If print data D is received from an information terminal apparatus, such as a PC, an image reading apparatus which reads a document, or the like, the printer 1 starts printing processing. The surfaces of the photosensitive drums 41B, 41Y, 41M, and 41C are uniformly positively charged by the chargers 50B, 50Y, 50M, and 50C with the rotation thereof. Laser light is irradiated from the exposure devices 49 toward the photosensitive drums 41B, 41Y, 41M, and 41C. Thus, predetermined electrostatic latent images based on print data are formed on the surfaces of the photosensitive drums 41B, 41Y, 41M, and 41C, that is, in the portions irradiated with laser light of the surfaces of the photosensitive drums 41B, 41Y, 41M, and 41C uniformly positively charged, the potential decreases.

Next, with the rotation of the developing rollers 45B, 45Y, 45M, and 45C, positively charged toner carried on the developing rollers 45B, 45Y, 45M, and 45C is supplied to the electrostatic latent images formed on the surfaces of the photosensitive drums 41B, 41Y, 41M, and 41C. Thus, the electrostatic latent images of the photosensitive drums 41B, 41Y, 41M, and 41C are visualized, and toner images are carried on the surface of the photosensitive drums 41B, 41Y, 41M, and 41C due to an inversion phenomenon.

In parallel with the above-described processing for forming the toner images, processing for conveying the sheets 15 is also performed. That is, with the rotation of the pickup roller 19, the sheets 15 are sent from the tray 17 to a sheet conveying path Y one by one. The sheet 15 sent to the sheet conveying path Y is transported to a transfer position (a point where the photosensitive drum 41 and the transfer roller 33 are in contact with each other) by the conveying roller 11 and the belt 34.

When this happens, when the sheet 15 passes through the transfer position, the toner images (developer images) of the respective colors carried on the surfaces of the photosensitive drums 41 are sequentially superimposingly transferred to the sheet 15 by a transfer bias applied to the transfer rollers 33. In this way, a color toner image (developer image) is formed on the sheet 15. Thereafter, when the sheet 15 passes through the fixing device 9 provided backward of the belt 34, the transferred toner images (developer images) are thermally fixed, and the sheet 15 is discharged onto a sheet discharge tray 60.

2. Electrical Configuration of High-Voltage Power Supply Device 100

Figure 2:
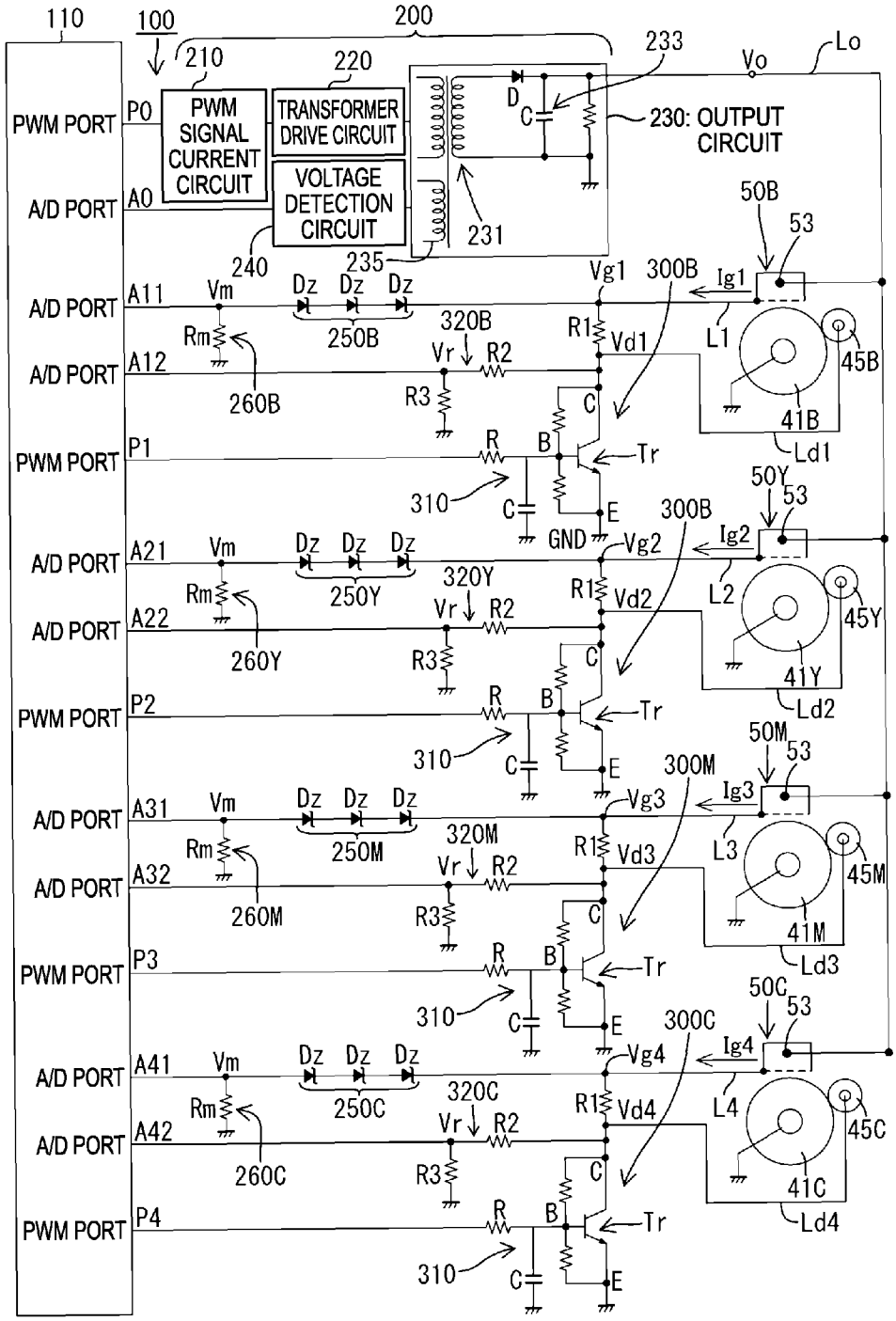
FIG. 2 is a block diagram showing the electrical configuration of a high-voltage power supply device.
Figure 3:
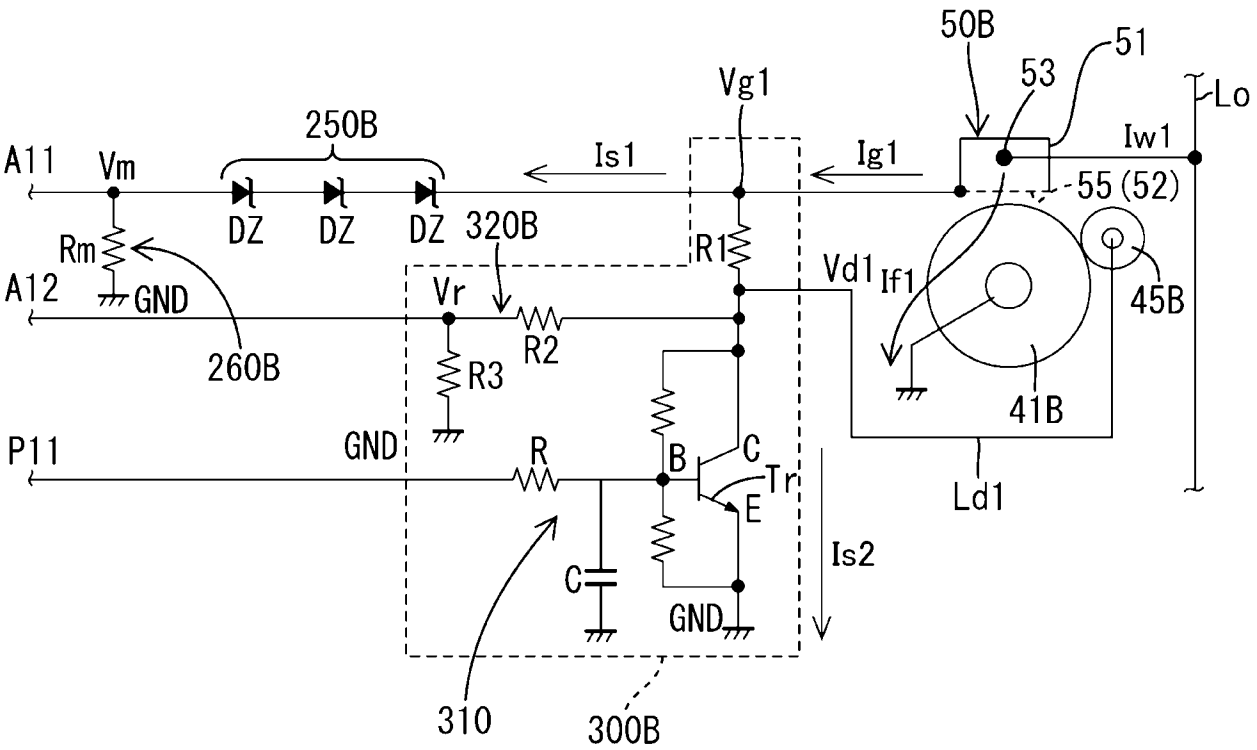
FIG. 3 is a circuit diagram of a deboost circuit (an enlarged view of a part of FIG. 2)

The high-voltage power supply device 100 has a function of applying a high voltage of about 6 kV to 7 kV to the chargers 50B, 50Y, 50M, and 50C, a function of constant-current controlling grid currents Ig1 to Ig4, and a function of applying developing voltages Vd1 to Vd4 of about 600 V to the developing rollers 45. As shown in FIG. 2, the high-voltage power supply device 100 includes a control device 110, a voltage application circuit 200, constant-voltage circuits 250B, 250Y, 250M, and 250C (collectively denoted by 250), current detecting sections 260B, 260Y, 260M, and 260C (collectively denoted by 260), deboost circuits 300B, 300Y, 300M, and 300C (collectively denoted by 300).

The control device (an example of a "first control device", an example of a "second control device", and an example of a "grid current calculating section" of the invention) 110 is constituted by a CPU or an application specific integrated circuit (ASIC). The control device 110 includes five PWM ports P0 to P4, nine A/D ports A0 to A42, and an internal memory (which stores various pieces of data including a circuit constant, such as a breakdown voltage or a resistance value of a Zener diode Dz).

The voltage application circuit 200 includes a PWM signal smoothing circuit 210, a transformer drive circuit 220, an output circuit 230, and a voltage detection circuit 240. The voltage application circuit 200 has a function of applying a high voltage of about 6 kV to 7 kV to the chargers 50. The PWM signal smoothing circuit 210 smoothes a PWM signal output from the PWM port P0 of the control device 110 and outputs the smoothed PWM signal to the transformer drive circuit 220. The transformer drive circuit 220 includes, for example, an amplifier element, such as a transistor, and causes an oscillation current of an operation point based on the duty ratio of the PWM signal to flow in the primary winding of a transformer 231.

The output circuit 230 includes a boost circuit which has the transformer 231, and a smoothing circuit 233 which has a diode D and a capacitor C. The output circuit 230 boosts and rectifies a primary voltage which is applied to the primary winding of the transformer 231, and outputs the boosted and rectified voltage. The wires 53 of the chargers 50B, 50Y, 50M, and 50C are connected commonly to an output line Lo of the output circuit 230. Thus, a configuration is made in which an output voltage Vo (about 6 kV to 7 kV) of the output circuit 230 is applied to the wires 53 of the chargers 50B, 50Y, 50M, and 50C.

An auxiliary winding 235 is provided in the transformer 231 of the output circuit 230. A configuration is made in which a voltage having a level based on a secondary voltage of the transformer 231 is generated in the auxiliary winding 235.

The current detection circuit 240 detects a voltage generated in the auxiliary winding 235 and inputs the detection result to the A/D port A0 of the control device 110. Thus, a configuration is made in which data of the secondary voltage of the transformer 231 is loaded in the control device 110.

The grids 55 of the chargers 50B, 50Y, 50M, and 50C are connected to the ground GND through connection lines L1 to L4. The constant-voltage circuits 250B, 250Y, 250M, and 250C and the current detecting sections 260B, 260Y, 260M, and 260C are respectively provided on the connection lines L1 to L4.

The constant-voltage circuits 250B, 250Y, 250M, and 250C respectively include three Zener diodes Dz connected in series with each other, and sets the voltage of the grid 55 of each of the chargers 50B, 50Y, 50M, and 50C to a constant voltage as a voltage value (for example, 250 V×3) obtained by tripling the breakdown voltage per Zener diode.

The current detecting sections 260B, 260Y, 260M, and 260C respectively include detection resistors Rm connected in series with the constant-voltage circuits 250B, 250Y, 250M, and 250C. The connection points of the detection resistors Rm and the constant-voltage circuits 250B, 250Y, 250M, and 250C are respectively connected to the A/D ports A11 to A41 provided in the control device 110 through signal lines.

From the above, a voltage proportional to the magnitude of a current flowing in each of the connection lines L1 to L4 are input to a corresponding one of the A/D ports A11 to A41. For this reason, the level of an input voltage Vm of each of the A/D port A11 to A41 is read, such that the control device 110 can calculate the magnitude of a first branch current Is1 flowing into the constant-voltage circuit 250 in each of the grid currents Ig1 to Ig4 of the channels (the chargers 50B, 50Y, 50M, and 50C of the respective colors) by the following expression (1) (see FIG. 3).

$$Is1=Vm/Rm \quad (1)$$

Is1: the first branch current branching into the constant-voltage circuit

Vm: the input voltage of each of the A/D ports A11 to A41

Rm: the resistance value of the detection resistor

The control device 110 totalizes the first branch current Is1 and a second branch current Is2 for each channel to calculate each of the grid currents Ig1 to Ig4. The second branch current Is2 is a current which branches into the deboost circuit 300 in the grid current Ig, and can be calculated by the following expression (4). The control device 110 calculates the grid currents Ig1 to Ig4 on the basis of the expressions (1), (2), and (4), such that the function of a "grid current calculating section" of the invention is realized.

$$Ig=Is1+Is2 \quad (2)$$

Ig: the grid current (collectively denotes the grid currents Ig1 to Ig4)

Is1: the first grid current branching into the constant-voltage circuit

Is2: the second branch current branching into the deboost circuit

The control device 110 controls the output voltage Vo of the voltage application circuit 200 such that the calculation value each of the grid currents Ig1 to Ig4 of the channels is equal to or greater than a target current value (for example, 0.25 mA) (realizes the function of a "first control device" of the invention).

In order that the calculation value of each of the grid currents Ig1 to Ig4 of the channels is equal to or greater than the target current value (for example, 0.25 mA), it should suffice that constant-current control is performed such that the grid current Ig of a channel having the smallest current value becomes the target current value.

In this way, if each of the grid currents Ig1 to Ig4 of the channels is controlled to be equal to or greater than the target current value, a predetermined amount of discharge current if flows in each of the photosensitive drums 41B to 41C, making it possible to sufficiently charge the photosensitive drums 41B to 41C. For this reason, there is no case where image quality is degraded due to lacking in the charging amount.

Next, the deboost circuits 300B, 300Y, 300M, and 300C (collectively denoted by 300) have a function of respectively applying the developing voltages Vd1 to Vd4 to the developing rollers 45B, 45Y, 45M, and 45C, and are individually provided to correspond to the developing rollers 45B, 45Y, 45M, and 45C.

As shown in FIG. 2, each of the deboost circuits 300B to 330C is provided between the grid 55 of a corresponding one of the chargers 50B to 50C and the ground GND, and is in parallel with a corresponding one of the constant-voltage circuits 250B to 250C. Hereinafter, the deboost circuit 300B will be representatively described with reference to FIG. 3. The deboost circuit 300B includes a resistor R1 and a control transistor Tr. One end of the resistor R1 is connected to the connection line L1 led from the grid 55 of the charger 50B.

The control transistor Tr is an NPN transistor, and has a collector C which is connected to the other end of the resistor R1 and an emitter E which is connected directly to the ground GND. A base B of the control transistor Tr is connected to the PWM port P1 of the control device 110 through a signal line. An integration circuit 310 having a capacitor C and a resistor R is provided in the signal line to smooth a PWM signal output from the PWM port P1 of the control device 110 and to apply the smoothed PWM signal to the base of the control transistor Tr. An output line Ld1 of the deboost circuit 300B is led from the connection point (that is, the collector C) of the resistor R1 and the control transistor Tr.

For this reason, an output voltage Vd1 of the deboost circuit 300B becomes a voltage value (about 600 V) which is deboosted from a grid voltage Vg (about 750 V) by the voltage of the resistor R1. The developing roller 45B is connected to the output line Ld1 of the deboost circuit 300B, such that the output voltage Vd1 of the deboost circuit 300B is applied to the developing roller 45B as a developing voltage.

Similarly to the deboost circuit 300B, each of the deboost circuits 300Y, 300M, and 300C has a resistor R1 and a control transistor Tr, and smoothes a PWM signal output from a corresponding one of the PWM ports P2 to P4 of the control device 110 and applies the smoothed PWM signal to the base B of the control transistor Tr. The output lines Ld2 to Ld4 of the deboost circuits 300Y, 300M, and 300C are respectively connected to the developing rollers 45Y, 45M, and 45C, such that the output voltages Vd2, Vd3, and Vd4 of the deboost circuits 300Y, 300M, and 300C are applied to the developing rollers 45Y, 45M, and 45C as a developing voltage. The first resistors R1 of the deboost circuits 300B to 300C have the same value, and may be set to different values.

As shown in FIG. 2, developing voltage detection circuits 320B to 320C are respectively provided in the deboost circuits 300B to 300C to detect the output voltages (developing voltages) Vd1 to Vd4. Each of the developing voltage detection circuits 320B to 320C has resistors R2 and R3 connected in series with each other. The developing voltage detection circuits 320B to 320C are respectively connected in parallel with the control transistors Tr of the deboost circuits 300B to 300C. That is, one of the resistor R2 is connected to the collector of the control transistor Tr, and one end of the resistor R3 is connected directly to the ground GND.

At an intermediate connection point of the resistors R2 and R3, a voltage Vr is generated which is obtained by dividing a corresponding one of the output voltages Vd1 to Vd4 of the deboost circuits 300 in accordance with a voltage-division ratio. Each of the A/D ports A12 to A42 of the control device 110 is connected to the intermediate connection point of the resistors R2 and R3 which constitute a corresponding one of the developing voltage detection circuits 320B to 320C.

Thus, the control device 110 can calculate each of the developing voltages Vd1 to Vd4 of the deboost circuits 300B to 300C from the level of the input voltage Vr of a corresponding one of the A/D ports A12 to A42 by the following expression (3).

$$Vd=(1+R2/R3)\times Vr \quad (3)$$

Vd: the developing voltage (collectively denotes Vd1 to Vd4)

R2, R3: the resistance value of the developing voltage detection circuit

The second branch current Is2 branching into the deboost circuit 300 in each of the grid currents Ig1 to Ig4 of the channels can be calculated by the following expression (4).

$$Is2=(Vg-Vd)/R1 \quad (4)$$

Is2: the second branch current branching into the deboost circuit

Vg: the grid voltage (collectively denotes Vg1 to Vg4)

Vd: the developing voltage (collectively denotes Vd1 to Vd4)

R1: the resistance value

The control device 110 provides a PWM signal to the deboost circuits 300B to 300C to control the value of a current flowing in the control transistor Tr such that the detection value of a corresponding one of the developing voltages Vd1 to Vd4 calculated by the expression (3) becomes a target value. Thus, the deboosting amount (the magnitude of a voltage drop in the first resistor R1) in each of the deboost circuits 300B to 300C is adjusted, and each of the developing voltages Vd1 to Vd4 is controlled to a target voltage (the function of a "second control device" of the invention is realized). In this way, in Embodiment 1, the developing voltage Vd is detected and fed back to the control device 110, making it possible to accurately control the developing voltage Vd to a target value.

The deboost circuits 300B to 300C are individually provided to correspond to the developing rollers 45B to 45C. Thus, for example, it is possible to individually set the target values of the developing voltages Vd1 to Vd4 for the developing rollers 45B to 45C such that the target value of the developing voltage Vd is set to be high for the developing roller 45 of one color from among the developing rollers 45B to 45C of the four colors, and the target value of the developing voltage Vd of another color is set to be low.

In general, toner of the respective colors is not easily charged due to deterioration, and the degree of progression of deterioration is not uniform. Even when the same developing voltage Vd is applied in the state of a new product, the easiness of charging may be different depending on the toner colors. For this reason, in order to increase image quality, it is necessary to set the developing voltage Vd in accordance with the property or the degree of deterioration of toner of each color. The printer 1 can cope with this demand because the developing voltages Vd1 to Vd4 of the developing rollers 45B to 45C can be individually controlled, thereby increasing image quality.

Each of the deboost circuits 300B to 300C uses a control method which adjusts the value of a current flowing in the resistor R1 by the control transistor Tr to adjust the level of a corresponding one of the developing voltages Vd1 to Vd4. For this reason, it is possible to continuously control the developing voltages Vd1 to Vd4 in a nonstep manner. Therefore, it becomes possible to minutely control the developing voltages Vd1 to Vd4, making it possible to further increase image quality.

The deboost circuit 300 is connected directly to the ground GND. For this reason, the reference potential is grounded and stabilized. From the above, the developing voltages Vd1 to Vd4 are stabilized, making it possible to further increase image quality. When the deboost circuit 300 is connected directly to the ground GND, this means that both the control transistor Tr and the developing voltage detection circuit 320 constituting the deboost circuit 300 are connected directly to the ground GND.

As described above, the printer 1 is configured such that the voltage application circuit 200 is shared by the chargers 50B, 50Y, 50M, and 50C, and each of the developing voltages Vd1 to Vd4 is produced by deboosting the output voltage Vo of the voltage application circuit 200. For this reason, it is possible to reduce the size of the high-voltage power supply device 100 constituting the printer 1. It is also possible to individually control the developing voltages Vd1 to Vd4, thereby achieving high image quality.

Embodiment 2

Embodiment 2 of the invention will be described with reference to FIG. 4.

In a printer 1 of Embodiment 2, the target value of each of the developing voltages Vd1 to Vd4 is changed depending on the magnitude of a corresponding one of the grid currents Ig1 to Ig4. Specifically, the control device 110 performs control to decrease the target value of the developing voltage Vd for the developing roller 45 corresponding to the charger 50, in which the grid current Ig is low, from among the developing rollers 45 and to increase the target value of the developing voltage Vd for the developing roller 45 corresponding to the charger 50 in which the grid current Id is high. Thus, the following effects can be obtained.

Figure 4:
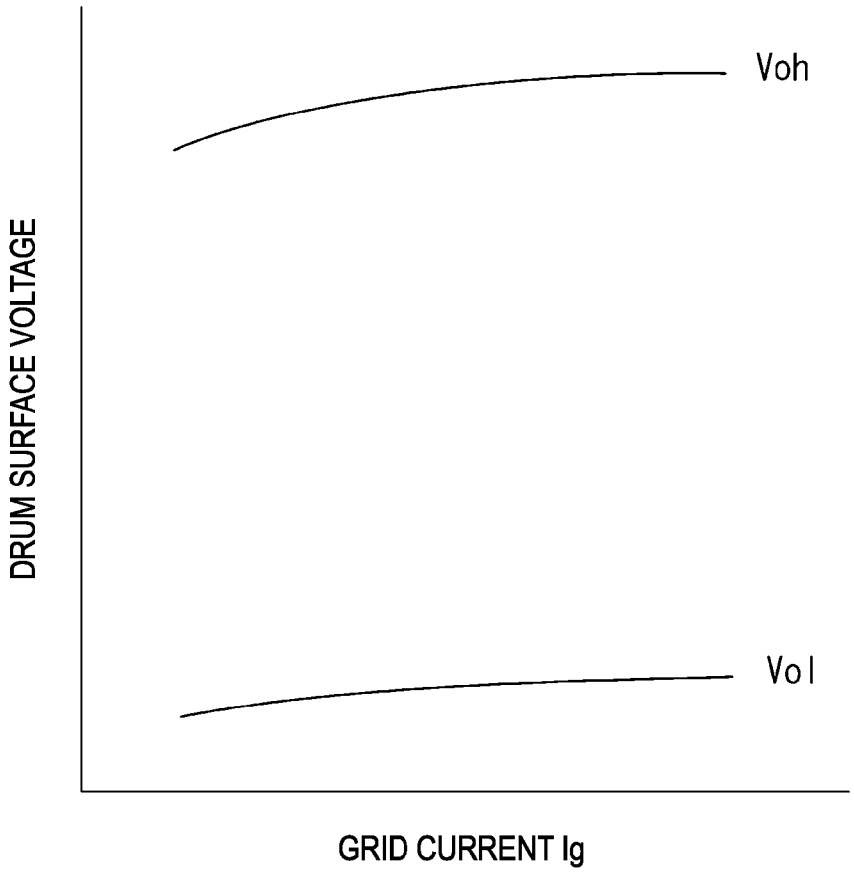
FIG. 4 is a diagram showing the relationship between a grid current and a drum surface potential of a photosensitive drum in Embodiment 2.

In general, as shown in FIG. 4, a drum surface potential Voh of the photosensitive drum 41 and a surface potential Vol at an exposed location tend to be high when the grid current Ig is great and to be low when the grid current Ig is small. In this embodiment, the target voltage of the developing voltage Vd decreases for the developing roller 45 corresponding to the charger 50 in which the grid current Ig is low, and the target voltage of the developing voltage Vd increases for the developing roller 45 corresponding to the charger 50 in which the grid current Ig is high.

For this reason, for the respective colors, it becomes possible to equalize the voltage difference of the drum surface potential Voh of each of the photosensitive drum 41B to 41C and the developing voltage Vd, and also to equalize the voltage difference between the drum surface potential Vol and the developing voltage Vd. For this reason, it becomes possible to allow toner to be uniformly stuck to the photosensitive drums 41B to 41C. Therefore, high image quality can be achieved.

Embodiment 3

Embodiment 3 of the invention will be described with reference to FIGS. 5 and 6.

In Embodiment 1, as the circuit example of the high-voltage power supply device 100, a configuration in which the constant-voltage circuit 250 is connected to the ground GND through the current detecting section 260, and the deboost circuit 300 is connected directly to the ground GND has been illustrated. In Embodiment 3, the configuration of the high-voltage power supply device 100 is partially changed from Embodiment 1. Thus, the common portions to the circuit of Embodiment 1 are represented by the same reference numerals, and description thereof will be omitted. Hereinafter, only differences will be described.

Figure 5:
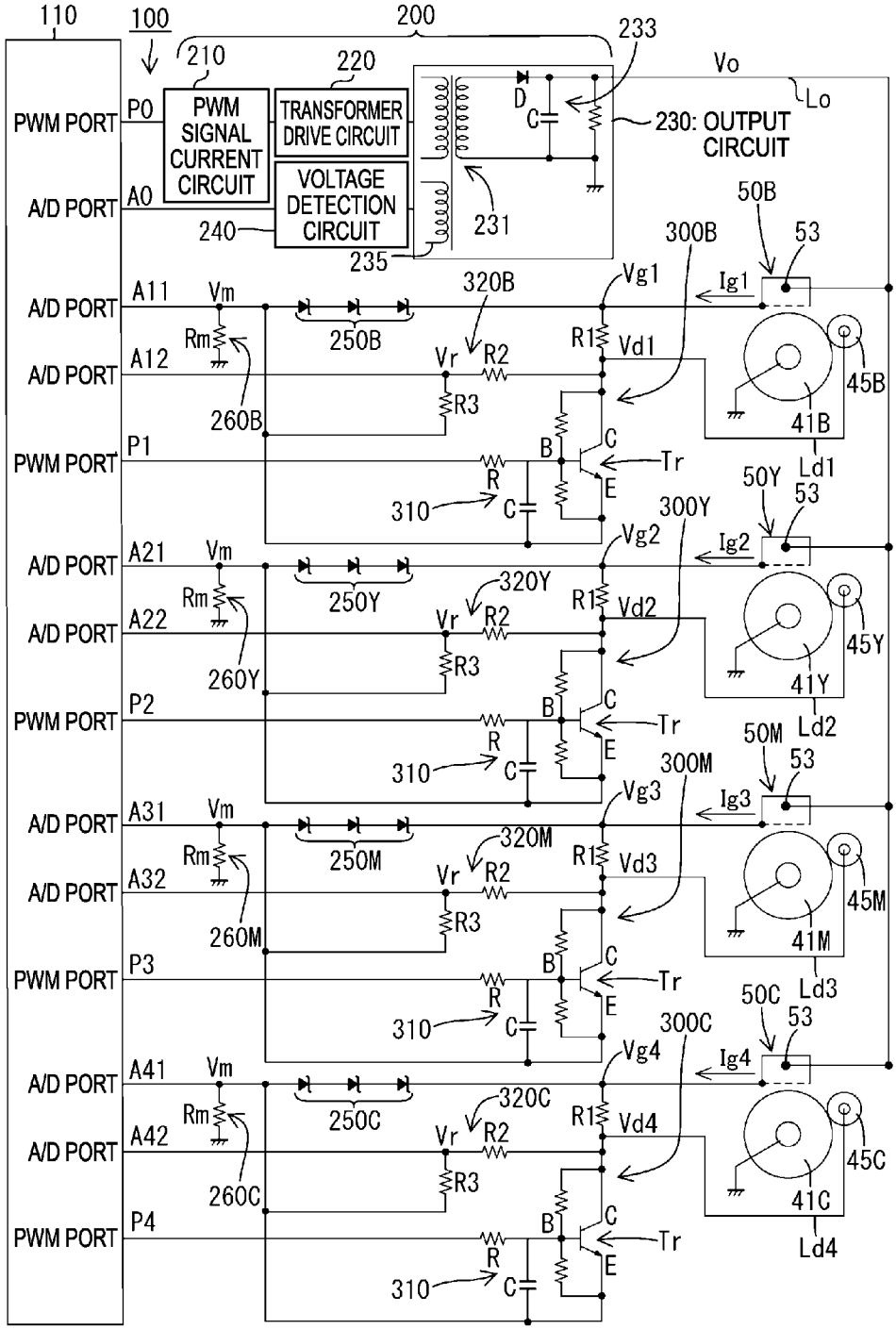
FIG. 5 is a block diagram showing the electrical configuration of a high-voltage power supply device in Embodiment 3.
Figure 6:
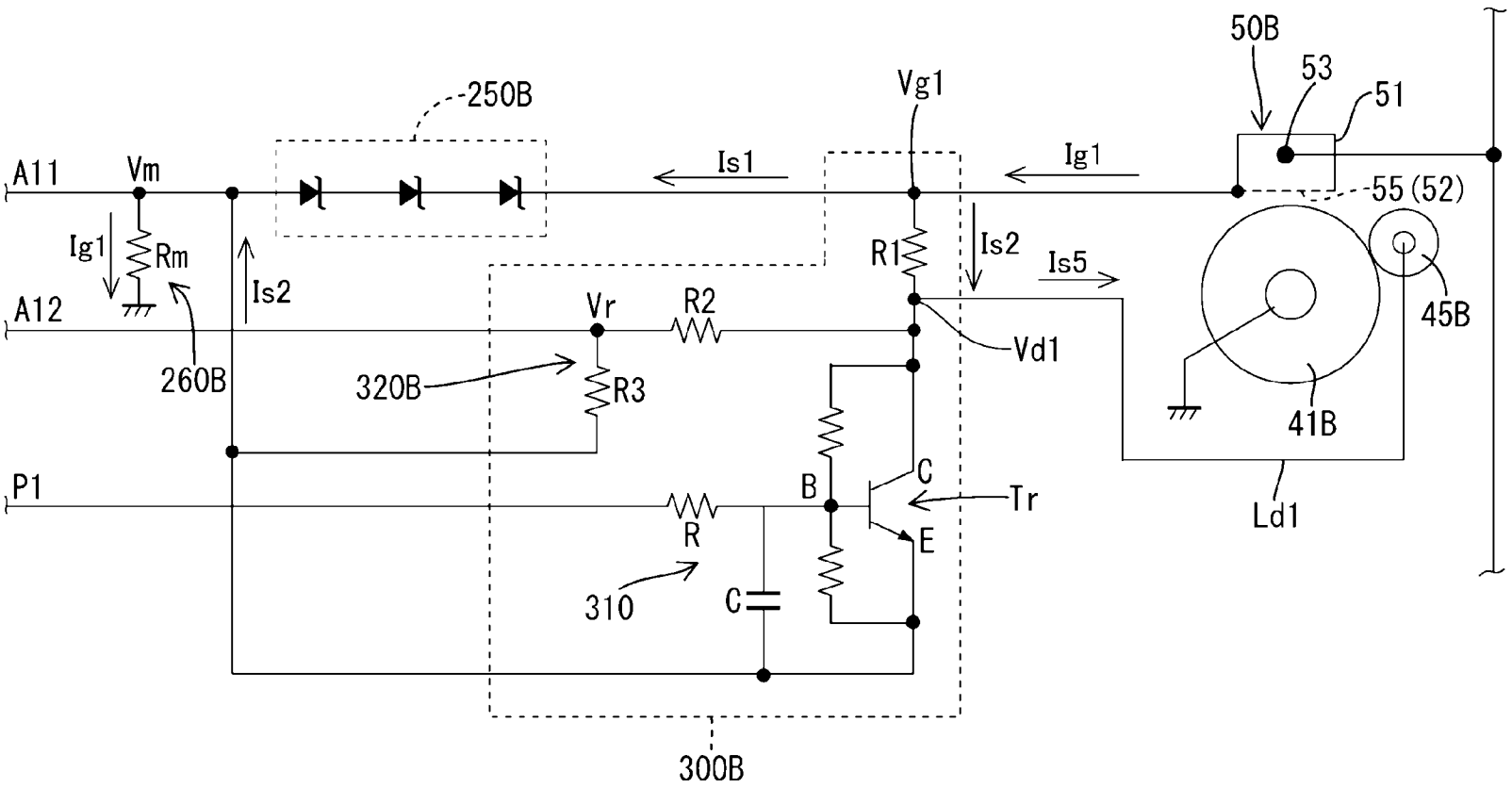
FIG. 6 is a circuit diagram of a deboost circuit (an enlarged view of a part of FIG. 5)

As shown in FIGS. 5 and 6, in Embodiment 3, a circuit configuration is made in which the constant-voltage circuit 250 and the deboost circuit 300 in each channel are connected to the ground GND through a common current detecting section 260 (specifically, a detection resistor Rm). With this circuit configuration, as shown in FIG. 6, the grid current Ig temporarily branches into the constant-voltage circuit 250 and the deboost circuit 300, then joins, and subsequently flows in the detection resistor Rm. Thus, a voltage Vm proportional to each of the grid currents Ig1 to Ig4 of the channels is input to a corresponding one of the A/D ports A11 to A41.

For this reason, the level of the input voltage Vm of each of the A/D ports A11 to A41, such that the control device 110 can calculate each of the grid currents Ig1 to Ig4 of the channels by the following expression (5). The control device 110 calculates the grid currents Ig1 to Ig4 on the basis of the expression (5), thereby realizing the function of a "grid current calculating section" of the invention.

$$Ig=Vm/Rm \quad (5)$$

Ig: the grid current (collectively denotes Ig1 to Ig4)

Vm: the input voltage of each of the A/D ports A11 to A41

Rm: the resistance value of the detection resistor

As shown in FIG. 6, a part of the second branch current Is2 branches and flows into the developing roller 45. However, while the second branch current Is2 is about 50 to 100 μA, a current Is5 branching into the developing roller 45 is about several μA and very small. Thus, even when the current Is5 is neglected, there is little influence in calculating the grid current Ig.

The control device 110 controls the output voltage Vo of the voltage application circuit 200 such that the grid current Ig of a channel having the smallest current value becomes a target current value (for example, 0.25 mA). From the above, all the grid currents Ig1 to Ig4 of the channels are equal to or greater than the target current value, such that a predetermined amount of discharge current If flows in each of the photosensitive drums 41B to 41C, making it possible to sufficiently charge each of the photosensitive drums 41B to 41C. For this reason, there is no case where image quality is deteriorated due to lacking in the charging amount.

In Embodiment 3, an arithmetic expression for calculating the grid currents Ig1 to Ig4 is simplified compared to Embodiment 1. For this reason, it becomes possible to simply and accurately obtain the grid currents Ig1 to Ig4. Thus, it becomes possible to accurately control the grid currents Ig1 to Ig4. The reason why the grid currents Ig1 to Ig4 can be obtained accurately is that the grid current Ig is determined by two numerical values of the input voltage Vm of each of the A/D ports A11 to A41 and the resistance value of the detection resistor Rm, thus an error does not easily occur.

In Embodiment 3, the developing voltage Vd can be obtained by the following expression (6).

$$Vd=Vm+(Vr-Vm)\times(1+R2/R3) \quad (6)$$

Vd: the developing voltage (collectively denotes Vd1 to Vd4)

Vm: the input voltage of each of the A/D ports A11 to A41

Vr: the input voltage of each of the A/D ports A12 to A42

R2, R3: the resistance value

In Embodiment 3, the control device 110 performs feedback control of the control transistor Tr of each of the deboost circuits 300B to 300C such that the developing voltage Vd obtained by the expression (6) becomes the target value. For this reason, in Embodiment 3, as in Embodiment 1, it is possible to accurately control the developing voltage Vd to the target value.

Embodiment 4

Embodiment 4 of the invention will be described with reference to FIGS. 7 and 8.

In Embodiment 1, as the circuit example of the high-voltage power supply device 100, a configuration in which the constant-voltage circuit 250 is connected to the ground GND through the current detecting section 260, and the deboost circuit 300 is connected directly to the ground GND has been illustrated. In Embodiment 4, the circuit configuration of the high-voltage power supply device 100 is partially changed from Embodiment 1. Thus, the common portions to the circuit of Embodiment 1 are represented by the same reference numerals, and description thereof will be omitted. Hereinafter, only differences will be described.

Figure 7:
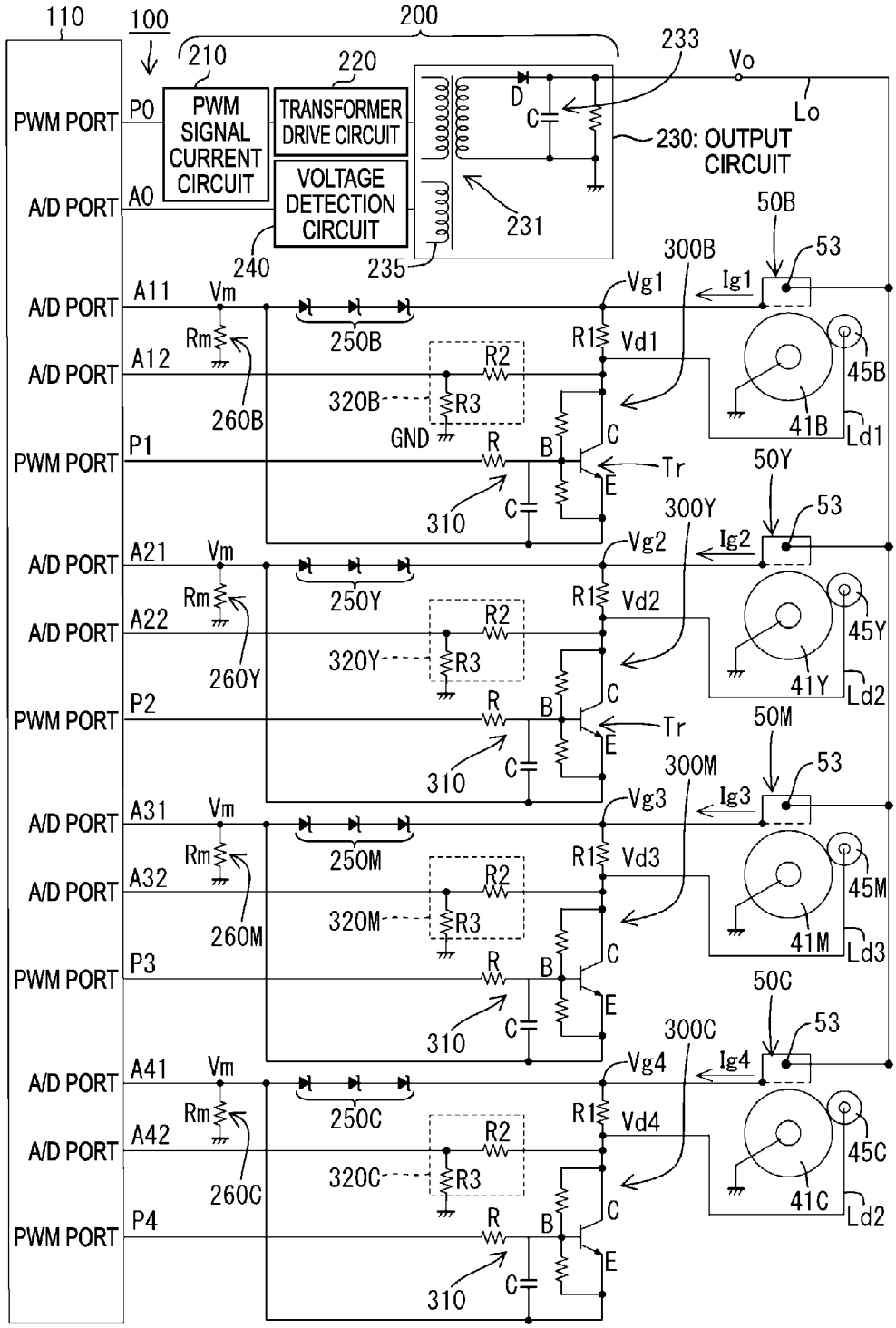
FIG. 7 is a block diagram showing the electrical configuration of a high-voltage power supply device in Embodiment 4.
Figure 8:
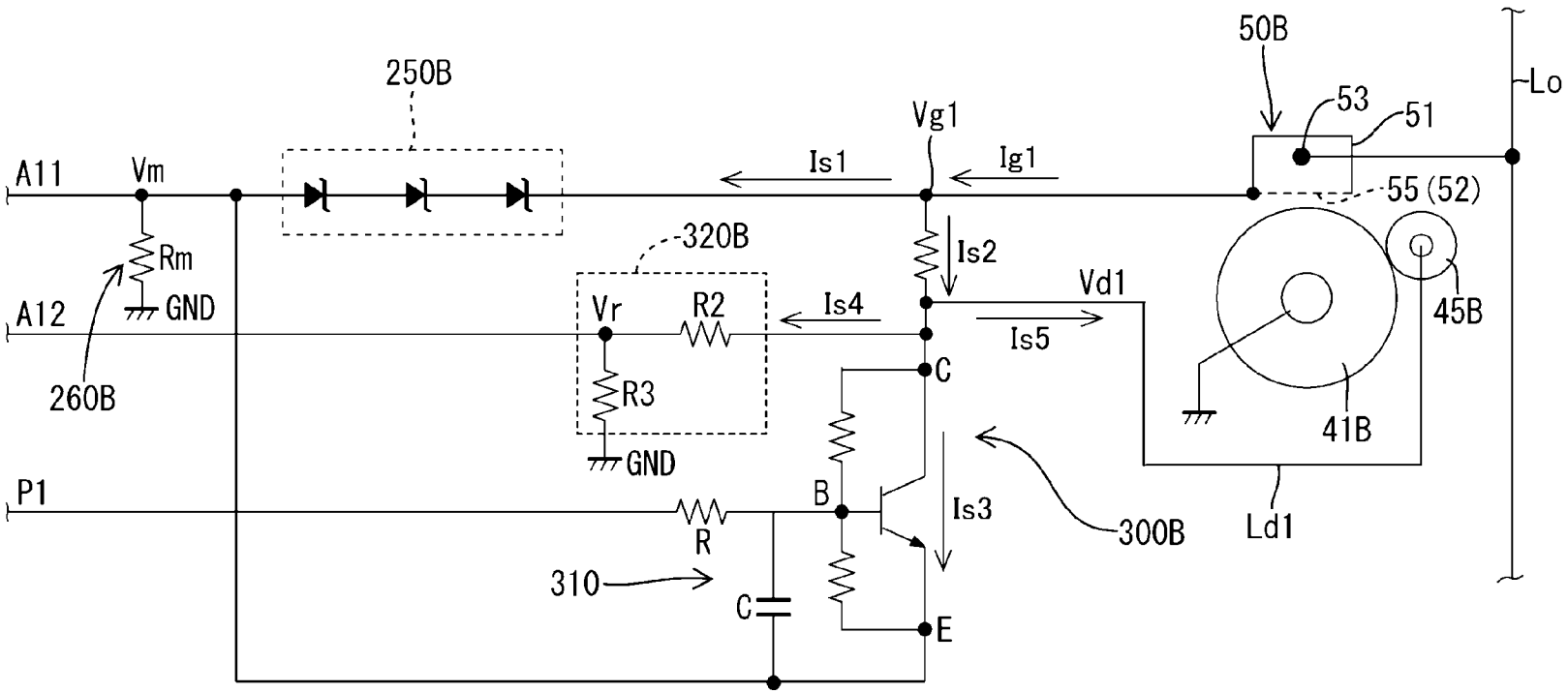
FIG. 8 is a circuit diagram of a deboost circuit (an enlarged view of a part of FIG. 7)

As shown in FIGS. 7 and 8, in Embodiment 4, the emitter E of the control transistor Tr of the deboost circuit 300 and the constant-voltage circuit 250 in each channel are connected to the ground GND through a common current detecting section 260 (specifically, a detection resistor Rm). The developing voltage detection circuit 320 of the deboost circuit 300 is connected directly to the ground GND.

With this circuit configuration, the first branch current Is1 branching into the constant-voltage circuit 250 in the grid current Ig flows into the detection resistor Rm. Meanwhile, the second branch current Is2 branching into the deboost circuit 300 in the grid current Ig further branches into the control transistor Tr and the developing voltage detection circuit 320. Similarly to the first branch current Is1, a third branch current Is3 branching into the control transistor Tr flows into the detection resistor Rm. A fourth branch current Is4 branching into the developing voltage detection circuit 320 does not flow into the detection resistor Rm and flows directly into the ground GND.

From the above, the grid currents Ig1 to Ig4 of the channels can be obtained by the following arithmetic operation.

First, the total current of the first branch current Is1 and the third branch current Is3 can be obtained by the following expression (7).

$$Is1+Is3=Vm/rm \quad (7)$$

Vm: the input voltage of each of the A/D ports A11 to A41

Rm: the resistance value of the detection resistor

The fourth branch current Is4 can be obtained by the following expression (8).

$$Is4=Vr/R3 \quad (8)$$

Vr: the input voltage of each of the A/D ports A12 to A42

R3: the resistance value

Thus, the current value obtained by the expression (7) and the current value obtained by the expression (8) are totalized, thereby obtaining the grid current Ig.

$$Ig=Is1+Is3+Is4 \quad (9)$$

The control device 110 calculates the grid currents Ig1 to Ig4 on the basis of the expressions (7) to (9), thereby realizing the function of a "grid current calculating section" of the invention.

The control device 110 controls the output voltage Vo of the voltage application circuit 200 such that the grid current Ig of a channel having the smallest current value becomes a target current value (for example, 0.25 mA). From the above, all the grid currents Ig1 to Ig4 of the channels are equal to or greater than the target current value, such that a predetermined amount of discharge current If flows into each of the photosensitive drums 41B to 41C, making it possible to sufficiently charge each of the photosensitive drums 41B to 41C. For this reason, there is no case where image quality is deteriorated due to lacking in the charging amount.

As in Embodiment 1, the control device 110 calculates each of the developing voltages Vd1 to Vd4 on the basis of the expression (3). The control device 110 provides a PWM signal to each of the deboost circuits 300B to 300C to control the value of a current flowing in the control transistor Tr such that the detection value becomes the target value. Thus, the deboosting amount (the magnitude of a voltage drop in the first resistor R1) in each of the deboost circuits 300B to 300C is adjusted, and each of the developing voltages Vd1 to Vd4 is controlled to the target voltage. In this way, in Embodiment 1, the developing voltage Vd is detected and fed back to the control device 110, making it possible to accurately control the developing voltage Vd to the target value. In the high-voltage power supply device 100 of Embodiment 4, as in Embodiment 1, the reference potential of the control transistor Tr of each of the deboost circuits 300B to 300C is connected to the ground GND. For this reason, the developing voltages Vd1 to Vd4 are comparatively stabilized compared to the circuit configuration of Embodiment 3. It is also possible to comparatively simply the grid current Ig compared to Embodiment 1.

Embodiment 5

Embodiment 5 of the invention will be described with reference to FIG. 9. In Embodiment 1, as the circuit example of the high-voltage power supply device 100, a configuration in which the constant-voltage circuits 250B to 250C are respectively provided in the channels has been illustrated. In Embodiment 5, the circuit configuration of the high-voltage power supply device 100 is partially changed, and a constant-voltage circuit 250 is used commonly in the channels. Thus, the common portions to the circuit of Embodiment 1 are represented by the same reference numerals, and description thereof will be omitted. Hereinafter, only differences will be described.

Figure 9:
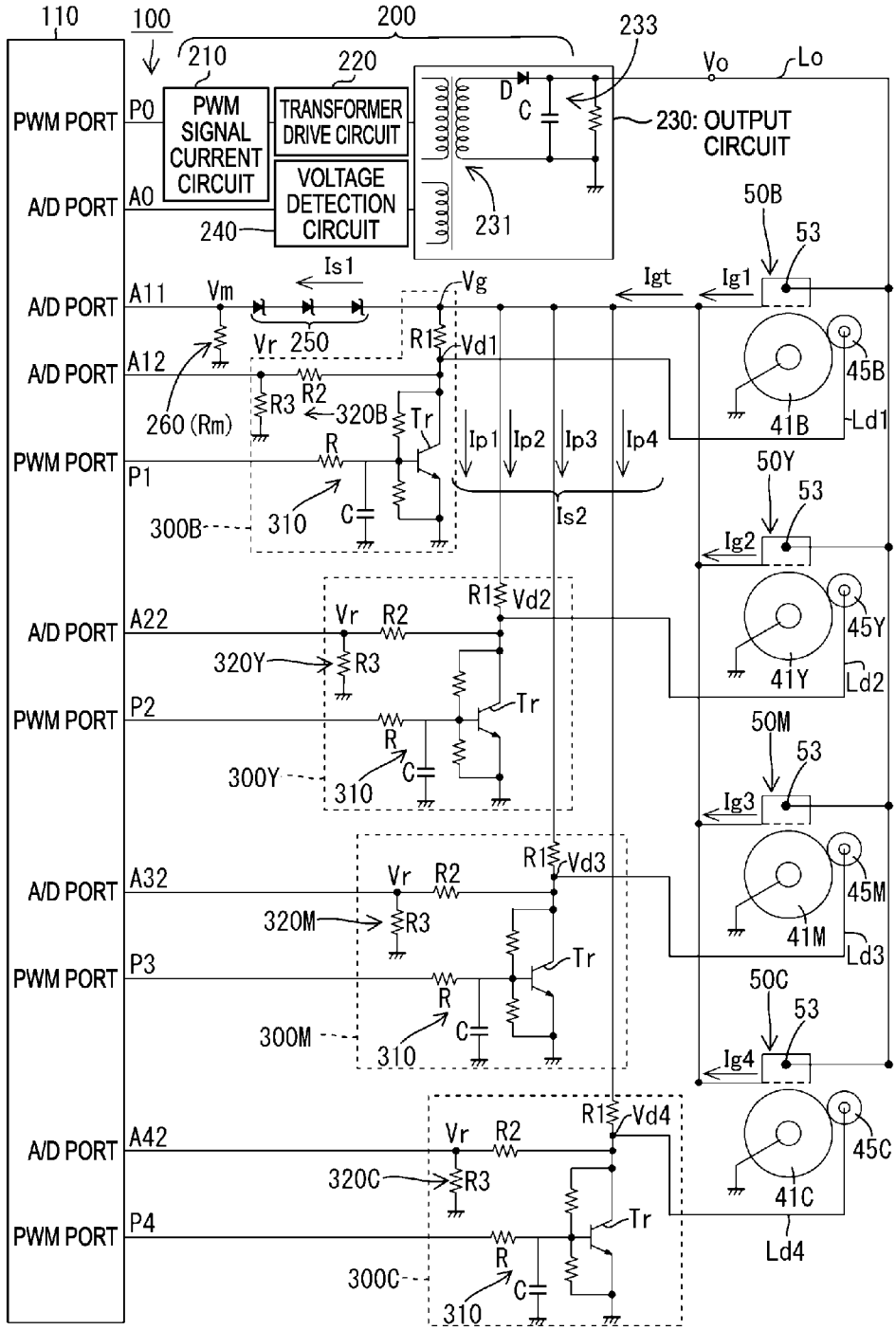
FIG. 9 is a block diagram showing the electrical configuration of a high-voltage power supply device in Embodiment 5.

As shown in FIG. 9, in the high-voltage power supply device 100 of Embodiment 5, the grids 55 of the chargers 50B, 50Y, 50M, and 50C are connected to the ground GND through a common connection line Lg. The constant-voltage circuit 250 and the current detecting section 260 are provided on the connection line Lg.

The constant-voltage circuit 250 has three Zener diodes connected in series with each other, and uniformly sets the value of the voltage of the grid 55 of each of the chargers 50B, 50Y, 50M, and 50C to a constant voltage as a voltage value (for example, 250 V×3) obtained by tripling the breakdown voltage per Zener diode.

The current detecting section 260 has a detection resistor Rm connected in series with the constant-voltage circuit 250. The connection point of the detection resistor Rm and each constant-voltage circuit 250 is connected to the A/D port A11 provided in the control device 110 through a signal line.

In Embodiment 5, the control device 110 totalizes the grid currents Ig1 to Ig4 flowing in the grids 55 of the channels to calculate a total grid current Igt. Specifically, in the total grid current Igt, a first branch current Is1 branching into the constant-voltage circuit 250 and a second branch current (the total current of branch currents Ip1 to Ip4 respectively branching into the deboost circuits 300B to 300C) Is2 branching into the deboost circuit 300 are calculated by the following expressions (10) and (11) and totalized to obtain the total grid current Igt.

The control device 110 controls the output voltage Vo of the voltage application circuit 200 such that the calculated total grid current Igt becomes the target value (for example, 1 mA). Thus, if constant-current control is performed on the total grid current Igt, the grid currents Ig1 to Ig4 at about a predetermined level (for example, 0.25 mA) with a slight variation respectively flow in the grids 55 of the chargers 50B to 50C. For this reason, a predetermined amount of discharge current If flows in each of the photosensitive drums 41B to 41C, making it possible to sufficiently charge each of the photosensitive drums 41B to 41C.

Next, the deboost circuits 300B, 300Y, 300M, and 300C have a function of respectively applying the developing voltages Vd1 to Vd4 to the developing rollers 45B, 45Y, 45M, and 45C, and as in Embodiment 1, are individually provided to correspond to the developing rollers 45B, 45Y, 45M, and 45C.

As in Embodiment 1, each of the deboost circuits 300B to 300C includes a first resistor R1 and a control transistor Tr. The deboost circuits 300B to 300C are connected commonly to the connection line Lg.

Thus, in Embodiment 5, as in Embodiment 1, it is possible to control the developing voltages Vd1 to Vd4 by channels. The developing voltage detection circuits 320B to 320C are respectively provided to detect the developing voltages Vd1 to Vd4 in the deboost circuits 300B to 300C, such that the developing voltage Vd is fed back to the control device 110. For this reason, as in Embodiment 1, it is possible to accurately control the developing voltage Vd to the target value.

In this embodiment, the voltage application circuit 200 and the constant-voltage circuit 250 are provided commonly between the chargers 50B to 50C. Thus, it becomes possible to reduce the number of circuits compared to a case where these circuits are separately provided in the chargers 50B to 50C. Therefore, it is possible to reduce the high-voltage power supply device 100 which constitutes the printer 1.

The first branch current Is1 can be obtained from the following expression (10). The second branch current Is2 can be calculated by calculating the branch currents Ip1 to Ip4 from the following expression (11) and totalizing the branch currents Ip1 to Ip4. The control device 110 calculates the total grid current Igt on the basis of the expressions (10) and (11), thereby realizing the function of a "grid current calculating section" of the invention.

$$Is1 = Vm/Rm \tag{10}$$

Vm: the input voltage of the A/D port A11

Rm: the resistance value of the detection resistor $$Ip = (Vg - Vd)/R1 \tag{11}$$

Ip: the branch current (collectively denotes Ip1 to Ip4) branching into each deboost circuit Vg: the grid voltage Vd: the developing voltage (collectively denotes Vd1 to Vd4)

R1: the resistance value

Embodiment 6

In Embodiment 1, as an example of the constant-voltage circuit 250 which sets the grid voltage Vg to a constant voltage, a circuit which uses a constant-voltage element (specifically, a Zener diode Dz) has been illustrated. Embodiment 6 is different from Embodiment 1 in that the constant-voltage circuit 250 is constituted by an analog constant-voltage circuit 350 using a control transistor Q. Thus, the common portions to the circuit of Embodiment 1 are represented by the same reference numerals, and description thereof will be omitted. Hereinafter, only differences will be described.

Figure 10:
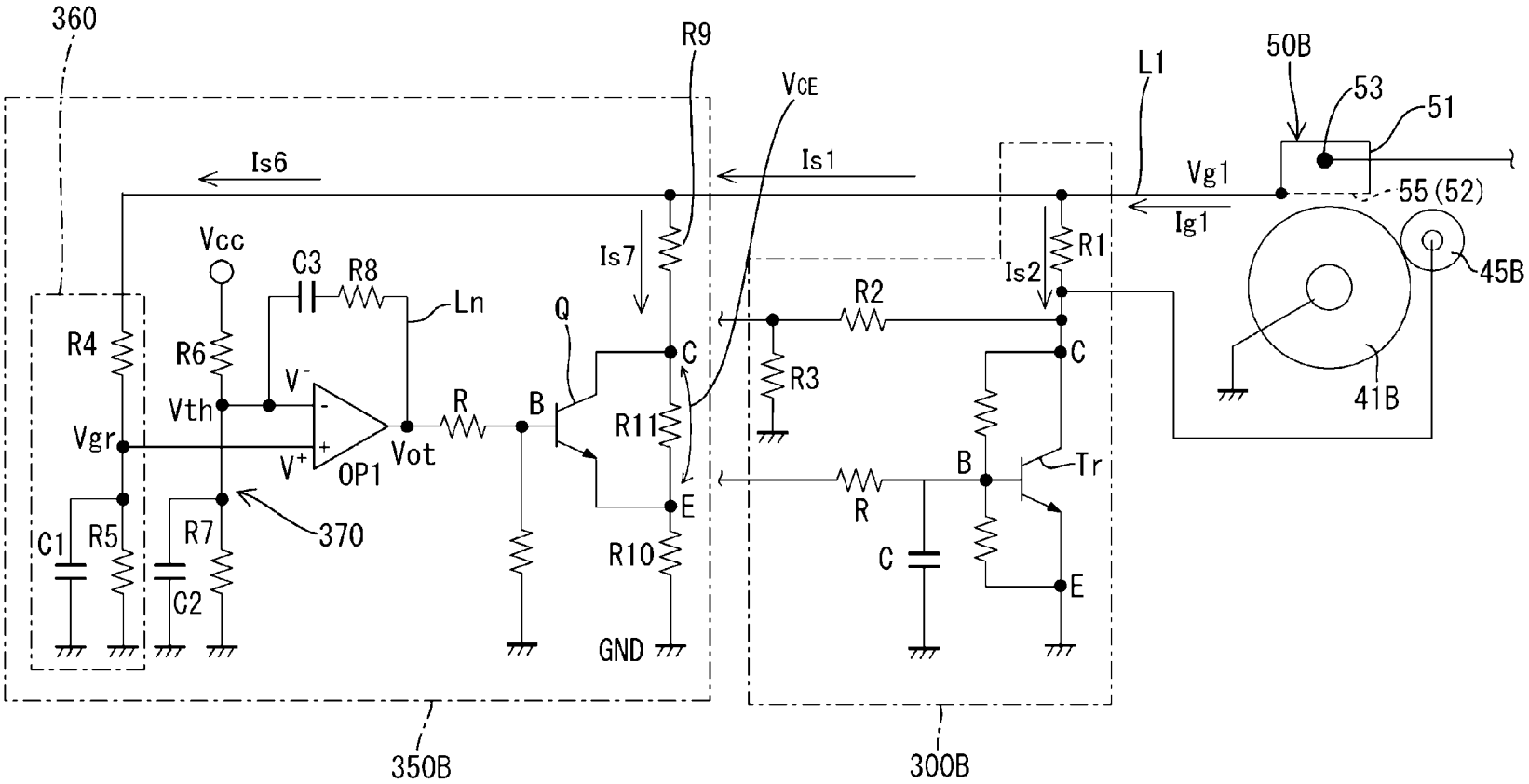
FIG. 10 is a circuit diagram of a constant-voltage circuit in Embodiment 6.

Analog constant-voltage circuits 350B to 350C are respectively provided in the grids 55 of the chargers 50B to 50C, and have a common configuration. Thus, the configuration of the analog constant-voltage circuit 350B corresponding to the charger 50B will be hereinafter described. As shown in FIG. 10, the analog constant-voltage circuit 350B includes an operational amplifier OP1, a grid voltage detection circuit 360, a reference voltage generation circuit 370, and a control transistor Q.

The grid voltage detection circuit 360 includes voltage-division resistors R4 and R5, and detects a voltage Vgr based on a grid voltage Vg1 by the voltage-division resistors R4 and R5. The detected voltage Vgr is input to a non-inverting input terminal V+ of the operational amplifier OP1.

The operational amplifier OP1 includes two input terminals (a non-inverting input terminal V+ and an inverting input terminal V−), and one output terminal Vot. A reference voltage Vth is provided to the inverting input terminal V− of the operational amplifier OP1 by the reference voltage generation circuit 370. The reference voltage generation circuit 370 divides, for example, a power supply voltage Vcc of 5V by voltage-division resistors R6 and R7 to generate the reference voltage Vth.

A base B of the control transistor Q is connected to the output terminal Vot of the operational amplifier OP1 through a resistor R. The control transistor Q is an NPN transistor. A collector C of the control transistor Q is connected to a connection line L1 through a resistor R9. An emitter E of the control transistor Q is connected to the ground GND through a resistor R10. A resistor R11 is connected between the collector C and the emitter E of the control transistor Q.

A feedback line Ln including a resistor R8 is connected between the output terminal Vot and the inverting input terminal V− of the operational amplifier OP1. From the above, negative feedback is applied, and the operational amplifier OP1 controls an output (that is, a base current) to the control transistor Q such that the terminal voltages of the two input terminals V− and V+ are equalized.

Thus, a collector current of the control transistor Q increases or decreases, and a collector-emitter voltage Vce is adjusted. Specifically, the voltage Vce is adjusted such that the detected voltage Vgr of the grid voltage detection circuit 360 becomes the reference voltage Vth. Therefore, the grid voltage Vg1 is adjusted to the target voltage.

In this way, if the constant-voltage circuit 250 is constituted by the analog constant-voltage circuit 350, it is possible to accurately control the grid voltage Vg1 to the target voltage compared to the constant-voltage circuit 250 using the Zener diode Dz in Embodiment 1. In general, the breakdown voltage of the Zener diode Dz has an error of about 5 to 10%. Thus, the voltage value of the grid voltage Vg1 also undergoes a variation of about 5 to 10%. In contrast, in the case of the analog constant-voltage circuit 350, the grid voltage Vg1 varies by an error in each of the resistors R4 to R7. However, an error in each of the resistors R4 to R7 is usually about 1%, and is significantly small compared to the Zener diode Dz. Therefore, it becomes possible to accurately control the grid voltage Vg1 to the target voltage as an error in each of the resistors R4 to R7 is small.

Next, description will be provided as to a method of calculating the grid current Ig1 when the constant-voltage circuit 250 is constituted by the analog constant-voltage circuit 350B. The grid current Ig1 of the charger 50B branches and flows into the analog constant-voltage circuit 350B and the deboost circuit 300B. The branch current Is1 branching into the analog constant-voltage circuit 350B further branches and flows in the grid voltage detection circuit 360 and the resistor R9.

For this reason, if a branch current Is6 branching into the grid voltage detection circuit 360 and a branch current Is7 branching into the resistor R9 are calculated and totalized, it is possible to obtain the branch current Is1 branching into the analog constant-voltage circuit 350B.

As described in Embodiment 1, the branch current Is2 branching into the deboost circuit 300B can be obtained by the expression (4). From the above, as in Embodiment 1, the branch current Is1 and the branch current Is2 are totalized, thereby calculating the grid current Ig1.

The control device 110 calculates the grid currents Ig1 to Ig4 for the channels, and as in Embodiment 1, controls the output voltage Vo of the voltage application circuit 200 such that the grid current having the smallest current value becomes the target current value (for example, 0.25 mA).

Thus, in Embodiment 6, as in Embodiment 1, it becomes possible to set the grid currents Ig1 to Ig4 of all the channels to be equal to or greater than the target current value.

In calculating the branch current Is6 branching into the grid voltage detection circuit 360 and the branch current Is7 branching into the resistor R9, it should suffice that a voltage applied to each of the resistors R5 and R10 is detected by the control device 110, and the detected voltage is divided by the corresponding resistance value.

As shown in FIG. 10, parallel capacitors C1 and C2 are respectively connected to the resistors R5 and R7. The parallel capacitor C1 delays the occurrence of a voltage in the resistor R5. The parallel capacitor C2 stabilizes the reference voltage Vth. A capacitor C3 is provided in the feedback line Ln to be in series with the resistor R8. The capacitor C3 delays the return of the output of the operational amplifier OP1 to the input side.

Other Embodiments

The invention is limited to the embodiments described with reference to the above description and the drawings, and for example, the following embodiments also fall within the technical scope of the invention.

(1) In Embodiments 1 to 6, as a configuration example of the printer 1, a color laser printer which includes four sets of photosensitive drums, chargers, developing rollers, and the like to correspond to toner of four colors has been illustrated. The printer 1 may not be a color printer, and may be a monochrome printer which includes one set of a photosensitive drum, a charger, a developing roller, and the like.

Figure 11:
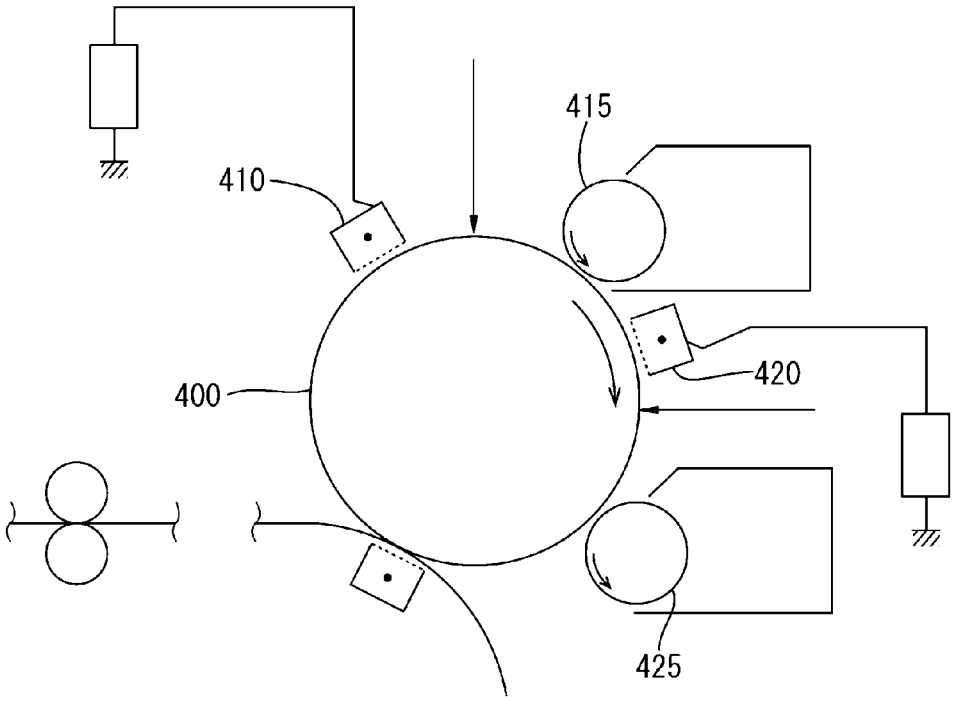
FIG. 11 is a diagram showing another example of the configuration of the printer.

(2) In Embodiments 1 to 6, as a configuration example of the printer 1, a configuration in which one charger 50 corresponds to one photosensitive drum 41 (in other words, the photosensitive drums 41 are provided by colors) has been illustrated. The invention may also be applied to, for example, a printer in which, as shown in FIG. 11, a plurality of chargers 410 and 420 and a plurality of developing rollers 415 and 425 are arranged to correspond to one photosensitive drum 400 (the toner images of respective colors are superimposed on the photosensitive drums 400 and collectively transferred to a sheet), in addition to the printer 1 having the configuration of each of Embodiments 1 to 4.

(3) Although in Embodiments 1 to 6, as an example of the control transistor Tr, an NPN transistor (bipolar type) has been illustrated, a PET (unipolar type) may be used.

(4) Although in Embodiments 1 to 5, as an example of the constant-voltage element, the Zener diode Dz has been illustrated, a varistor may be used.

(5) Although in Embodiments 1 to 5, as an example of the current detecting section 260, a resistance detection type has been illustrated, a current sensor using a hole element.

What is claimed is:

1. An image forming apparatus comprising:
- a photosensitive member;
- a scorotron charger including a wire and a grid, and configured to charge the photosensitive member;
- a developing device configured to supply a developer to the photosensitive member;
- a voltage application circuit configured to apply a voltage to the scorotron charger;
- a constant-voltage circuit configured to set a grid voltage of the grid to a constant voltage between the grid and a ground;
- a control device configured to control an output voltage of the voltage application circuit; and
- a deboost circuit configured to deboost the grid voltage between the grid and the ground to generate a developing voltage to be applied to the developing device, wherein:
- the deboost circuit has a circuit configuration in which a resistor and a control transistor are connected in series with each other, and is configured to deboost the grid voltage by a voltage drop of the resistor to generate the developing voltage, the deboost circuit including a developing voltage detection circuit configured to detect the developing voltage,
- the constant-voltage circuit is connected to the ground through a current detecting section,
- the control device is further configured to:
  - calculate a grid current flowing in the grid by:
    - calculating a first branch current in the grid current branching into the constant-voltage circuit from a detection value of the current detecting section,
    - calculating a second branch current in the grid current branching into the deboost circuit based on a voltage difference between the grid voltage and the developing voltage and the resistor, and
    - totaling the calculated first branch current and the calculated second branch current as the grid current,
  - control the output voltage of the voltage application circuit such that the grid current becomes a target current value, and
  - control an output of the deboost circuit, by providing a control signal to the control transistor, to control a current flowing in the resistor such that a detection value of the developing voltage detection circuit becomes a target voltage value of the developing voltage, and
- the deboost circuit is directly connected to the ground.

2. The image forming apparatus according to claim 1, wherein:
- the constant-voltage circuit and the deboost circuit are connected to the ground through a common current detecting section, and
- the control device is configured to calculate the grid current based on a detection value of the common current detecting section.

3. An image forming apparatus comprising:
- a photosensitive member;
- a scorotron charger including a wire and a grid, and configured to charge the photosensitive member;
- a developing device configured to supply a developer to the photosensitive member;
- a voltage application circuit configured to apply a voltage to the scorotron charger;
- a constant-voltage circuit configured to set a grid voltage of the grid to a constant voltage between the grid and a ground;
- a control device configured to control an output voltage of the voltage application circuit; and
- a deboost circuit configured to deboost the grid voltage between the grid and the ground to generate a developing voltage to be applied to the developing device, wherein:
- the deboost circuit has a circuit configuration in which a resistor and a control transistor are connected in series with each other, and is configured to deboost the grid voltage by a voltage drop of the resistor to generate the developing voltage, the deboost circuit including a developing voltage detection circuit configured to detect the developing voltage, the control device is further configured to:

calculate a grid current flowing in the grid, control the output voltage of the voltage application circuit such that the grid current becomes a target current value, and control an output of the deboost circuit, by providing a control signal to the control transistor, to control a current flowing in the resistor such that a detection value of the developing voltage detection circuit becomes a target voltage value of the developing voltage, the constant-voltage circuit and the control transistor of the deboost circuit are connected to the ground through a common current detecting section, the developing voltage detection circuit of the deboost circuit is connected directly to the ground, and the control device is configured to calculate the grid current by:

calculating a total current of a first branch current in the grid current branching into the constant-voltage circuit and a second branch current branching into the control transistor of the deboost circuit based on a detection value of the common current detecting section, calculating a third branch current in the grid current branching into the developing voltage detection circuit of the deboost circuit based on the detection value of the developing voltage detection circuit and a resistance value of the developing voltage detection circuit, and totaling the calculated total current and the calculated third branch current as the grid current.

4. An image forming apparatus comprising:

a single or a plurality of photosensitive members;

a scorotron charger including a wire and a grid, and configured to charge the single or the plurality of photosensitive members;

a developing device configured to supply a developer to the single or the plurality of photosensitive members;

a voltage application circuit configured to apply a voltage to the scorotron charger;

a constant-voltage circuit configured to set a grid voltage of the grid to a constant voltage between the grid and a ground;

a control device configured to control an output voltage of the voltage application circuit; and a deboost circuit configured to deboost the grid voltage between the grid and the ground to generate a developing voltage to be applied to the developing device, wherein:

the deboost circuit has a circuit configuration in which a resistor and a control transistor are connected in series with each other, and is configured to deboost the grid voltage by a voltage drop of the resistor to generate the developing voltage, the deboost circuit including a developing voltage detection circuit configured to detect the developing voltage, the control device is further configured to:

calculate a grid current flowing in the grid, control the output voltage of the voltage application circuit such that the grid current becomes a target current value, and control an output of the deboost circuit, by providing a control signal to the control transistor, to control a current flowing in the resistor such that a detection value of the developing voltage detection circuit becomes a target voltage value of the developing voltage, a plurality of scorotron chargers are provided for the single photosensitive member or are respectively provided for the plurality of photosensitive members to charge the single or the plurality of the photosensitive members, a plurality of developing devices are provided for the single photosensitive member or are respectively provided for the plurality of the photosensitive members to supply developers of respective colors to the single or the plurality of the photosensitive members, the scorotron chargers are commonly connected to the voltage application circuit, a plurality of grids of the scorotron chargers are commonly connected to the constant-voltage circuit, and the control device is configured to calculate a total grid current by totaling the grid current flowing in each of the grids.

5. An image forming apparatus comprising:

a single or a plurality of photosensitive members;

a scorotron charger including a wire and a grid, and configured to charge the single or the plurality of photosensitive members;

a developing device configured to supply a developer to the single or the plurality of photosensitive members;

a voltage application circuit configured to apply a voltage to the scorotron charger;

a constant-voltage circuit configured to set a grid voltage of the grid to a constant voltage between the grid and a ground;

a control device configured to control an output voltage of the voltage application circuit; and a deboost circuit configured to deboost the grid voltage between the grid and the ground to generate a developing voltage to be applied to the developing device, wherein:

the deboost circuit has a circuit configuration in which a resistor and a control transistor are connected in series with each other, and is configured to deboost the grid voltage by a voltage drop of the resistor to generate the developing voltage, the deboost circuit including a developing voltage detection circuit configured to detect the developing voltage, and the control device is further configured to:

calculate a grid current flowing in the grid, control the output voltage of the voltage application circuit such that the grid current becomes a target current value, and control an output of the deboost circuit, by providing a control signal to the control transistor, to control a current flowing in the resistor such that a detection value of the developing voltage detection circuit becomes a target voltage value of the developing voltage, a plurality of scorotron chargers are provided for the single photosensitive member or are respectively provided for the plurality of the photosensitive members to charge the single or the plurality of the photosensitive members, a plurality of developing devices are provided for the single photosensitive member or are respectively provided for the plurality of the photosensitive members to supply developer of respective colors to the single or the plurality of the photosensitive members, the scorotron chargers are commonly connected to the voltage application circuit, the constant-voltage circuit is individually provided to each of a plurality of grids of the scorotron chargers, and the control device is further configured to:

calculate the grid current flowing in each of the grids of the scorotron chargers, and decrease a target voltage value of the developing voltage to the developing device corresponding to the scorotron charger, in which the grid current is low, from among the developing devices of the respective colors, and to increase a target voltage value of the developing voltage to the developing device corresponding to the scorotron charger, in which the grid current is high, from among the developing devices of the respective colors.

* * * * *